US006955010B2

(12) United States Patent
Martin

(10) Patent No.: US 6,955,010 B2
(45) Date of Patent: Oct. 18, 2005

(54) CONTINUOUS SOFFIT PANEL AND ASSOCIATED METHODS

(75) Inventor: Gary L. Martin, Bradenton, FL (US)

(73) Assignee: Ashe Industries, Tampa, FL (US)

( * ) Notice: Subject to any disclaimer, the term of this patent is extended or adjusted under 35 U.S.C. 154(b) by 2 days.

(21) Appl. No.: 09/801,512

(22) Filed: Mar. 7, 2001

(65) Prior Publication Data

US 2002/0124484 A1 Sep. 12, 2002

(51) Int. Cl.[7] ..... E04D 13/00

(52) U.S. Cl. ..... 52/94; 52/95; 52/58; 52/60; 52/96; 52/93.2

(58) Field of Search ..... 52/94, 95, 506.01, 52/506.04, 506.05, 506.07, 506.1, 518, 506.09, 58, 60, 96, 90.1–93.2, 74–78, 519–532, 543–560, 11–16, 24–26, 57

(56) References Cited

U.S. PATENT DOCUMENTS

| | | | | | |
|---|---|---|---|---|---|
| 2,469,840 | A | * | 5/1949 | Orth | 52/60 |
| 2,559,209 | A | | 7/1951 | Alderfer et al. | |
| 3,204,374 | A | * | 9/1965 | Hellekson | 52/94 |
| 3,218,773 | A | * | 11/1965 | Heirich | 52/521 |
| 3,365,847 | A | * | 1/1968 | Josek | 52/94 |
| 4,092,808 | A | | 6/1978 | Maloney, Jr. et al. | |
| 4,195,455 | A | * | 4/1980 | Chalmers et al. | 52/94 |
| 4,309,857 | A | * | 1/1982 | Lovering | 52/632 |
| 4,347,691 | A | * | 9/1982 | Lloyd-Jones | 52/95 |
| 4,561,233 | A | * | 12/1985 | Harter et al. | 52/506.1 |
| 4,605,020 | A | * | 8/1986 | Lavoie | 132/150 |
| 4,608,788 | A | * | 9/1986 | Porter et al. | 52/64 |
| 4,685,256 | A | * | 8/1987 | Alkjaer | 52/58 |
| 5,181,350 | A | * | 1/1993 | Meckstroth | 52/12 |
| 5,195,283 | A | | 3/1993 | MacLeod et al. | |
| 5,251,411 | A | * | 10/1993 | Kelley et al. | 52/60 |
| 5,315,799 | A | * | 5/1994 | Cullinan | 52/288.1 |
| 5,375,379 | A | * | 12/1994 | Meckstroth | 52/12 |
| 5,414,965 | A | * | 5/1995 | Kelley et al. | 52/60 |
| 5,459,965 | A | * | 10/1995 | Meckstroth | 52/12 |
| 5,519,969 | A | * | 5/1996 | Golba | 52/60 |
| 5,537,785 | A | | 7/1996 | Zaccagni | |
| 5,560,158 | A | | 10/1996 | Norton | |
| 5,564,233 | A | | 10/1996 | Norton | |
| 5,638,643 | A | * | 6/1997 | Demartini et al. | 52/11 |
| 5,711,117 | A | | 1/1998 | Zaccagni et al. | |
| 5,729,933 | A | | 3/1998 | Strength | |

(Continued)

FOREIGN PATENT DOCUMENTS

| | | |
|---|---|---|
| DE | 3538997 | * 5/1987 |
| GB | 2231347 | * 11/1990 |

*Primary Examiner*—Jeanette E. Chapman
(74) *Attorney, Agent, or Firm*—Allen, Dyer, Doppelt, Milbrath & Gilchrist, P.A.

(57) ABSTRACT

An elongate continuous soffit panel having an adjustable width comprises a first member having a soffit portion including a proximal periphery and a generally parallel and spaced apart distal periphery extending along a lengthwise dimension of the soffit panel, and having a fascia portion coextensive with the soffit portion along the distal periphery and extending generally upwardly therefrom for fastening the soffit panel to roof fascia of a building. The continuous soffit panel also comprises a second member connected to the first member and having a flange portion extending generally at an angle from the soffit portion of the first member for fastening the soffit panel to a side of a building, the second member being adjustably connected to the first member so that the width of the soffit panel is adjustable responsive to variations in distance between the side of the building and the roof fascia. The second member includes a channel for therein engaging a proximal periphery of the soffit portion of the first member, thereby adjustably connecting the first member to the second member so that the width of the soffit panel is responsive to variations in distance between the side of the building and the roof fascia.

14 Claims, 3 Drawing Sheets

U.S. PATENT DOCUMENTS 5,735,084 A 4/1998 Zaccagni et al.
5,740,636 A * 4/1998 Archard ..... 52/94
5,797,220 A 8/1998 Zaccagni
5,899,026 A * 5/1999 Williams et al. ..... 52/58
5,941,028 A * 8/1999 Hicks ..... 52/95
5,950,375 A 9/1999 Zaccagni
6,474,032 B1 * 11/2002 Wynn ..... 52/405.2
6,539,675 B1 * 4/2003 Gile ..... 52/96

* cited by examiner

CONTINUOUS SOFFIT PANEL AND ASSOCIATED METHODS

FIELD OF THE INVENTION

The present invention relates to the field of building construction and, more particularly, to a continuous soffit panel for installation under a building's roof eaves.

BACKGROUND OF THE INVENTION

Commonly, homes and other buildings include a roof which overhangs the side walls of the building by a certain distance. The undersides of such a roof overhang, also known as roof eaves, are typically covered with an exterior grade material in order to hide roof support members from view, and to close exterior access to the attic space formed between the roof and the building's interior ceiling. The material used to cover the eaves is generally known as the roof soffit. The soffit extends between the building's exterior wall and the edge of the roof, this edge or border also being known as the roof fascia. The roof fascia may be a separate member independent of the soffit, and to which the soffit material is secured. Alternatively, the roof fascia may be formed by an extension of the soffit material which is then fastened to the ends of roof support members. Ventilation is usually provided by positioning vents, or openings, along the soffit to allow air flow into the attic space.

Conventional soffits are installed under roof eaves so that the soffit pieces run perpendicularly between the side wall of the building and the roof fascia. Such installation requires that skilled workers measure, cut, and interlock many short soffit panels to finish the entire eave along a building's exterior wall. This process is labor intensive, requires highly skilled workers, and consumes much time. Accordingly, the conventional process of installing soffit is quite laborious and expensive. The present invention results in significant savings over conventional soffit installations, particularly when the soffit panel disclosed herein is formed on-site at the construction project, and in a length sufficient to provide a single continuous soffit panel for an entire roof eave of a building.

SUMMARY OF THE INVENTION

With the foregoing in mind, the present invention advantageously provides a continuous soffit panel having an adjustable width. The soffit panel disclosed comprises a first member having a soffit portion, and a fascia portion. The first member preferably has a soffit portion including a proximal periphery and a generally parallel and spaced apart distal periphery extending along a lengthwise dimension of the soffit panel, and also has a fascia portion coextensive with the soffit portion along the distal periphery and extending generally upwardly therefrom for fastening the soffit panel to roof fascia of a building.

A second member is connected to the first member and has a flange portion extending generally at an angle from the soffit portion of the first member for fastening the soffit panel to the side of a building. The second member has a connecting portion for connecting with the first member, the connecting portion preferably having a channel wherein a periphery of the first member is adjustably engaged. The width of the soffit panel is, therefore, adjustably responsive to variations in distance between the side of the building and the roof fascia by varying the position of the periphery of the first member within the channel of the second member.

A method is disclosed for making the elongate continuous soffit panel having an adjustable width. In the method, a first member is formed including a soffit portion having a proximal periphery and a distal periphery disposed spaced apart, approximately parallel to each other, and extending along an elongated dimension of the soffit panel, and a fascia portion coextensive with the soffit portion along the distal periphery and extending generally upwardly therefrom. The second member is formed having a flange portion, and a connecting portion. The flange portion extends generally at an angle from the connecting portion. The connecting portion preferably is formed including a channel, and the first and second members are connected by slidably engaging a proximal periphery of the soffit portion of the first member within the channel of the second member, so that the width of the soffit panel can thereby be adjusted. It should be understood that, while a preferred connection has been described for connecting the first and second members of the soffit panel, various other ways are known in the art for adjustably connecting the two to thereby provide a continuous soffit panel having adjustable width.

The first member may also be formed to include an air vent or, alternatively, a plurality of openings in the soffit portion to thereby provide ventilation. The first and second members are preferably formed of sheet metal, and particularly aluminum sheet metal. The fascia portion of the first member may be dimensioned to serve as the roof fascia.

In accomplishing the method of the invention, the first and second members are best formed sufficiently elongated to provide a single continuous soffit panel for one wall of the building. The soffit panel disclosed provides a great advantage when formed on-site at a construction project, for example, as continuous panels formed by extrusion molding of aluminum sheet metal.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

Figure 1:
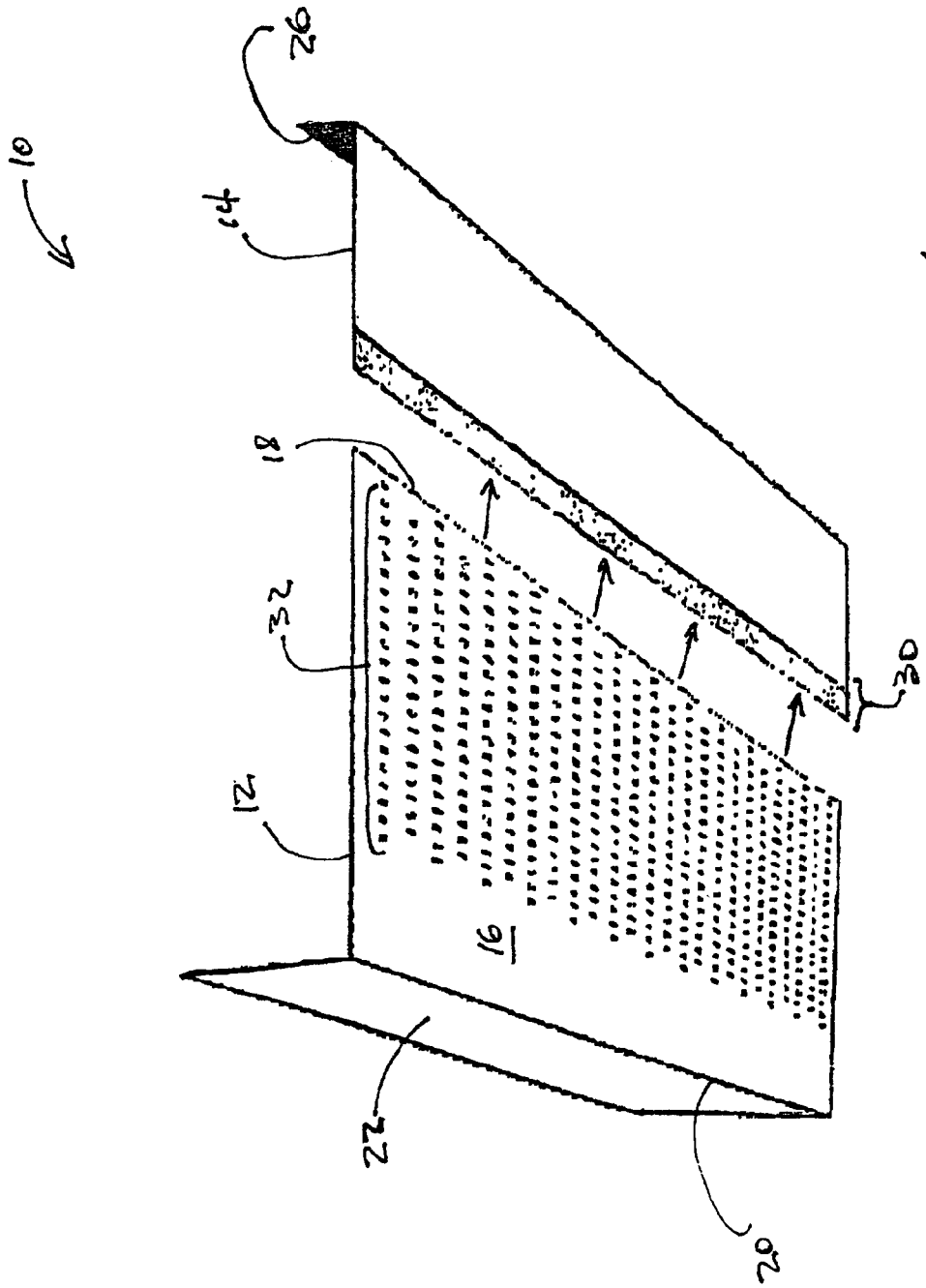
FIG. 1 is a perspective view of the soffit panel according to an embodiment of the present invention.
Figure 2:
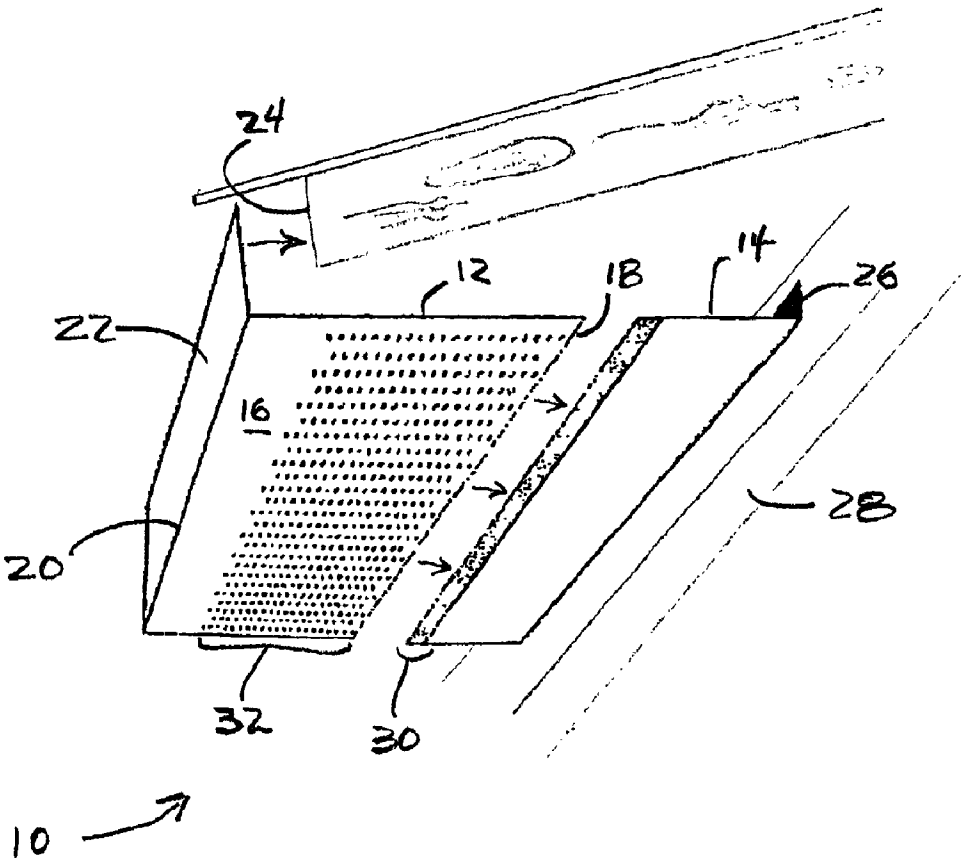
FIG. 2 is a perspective view of the soffit panel of FIG. 1 as installed on a building.
Figure 3:
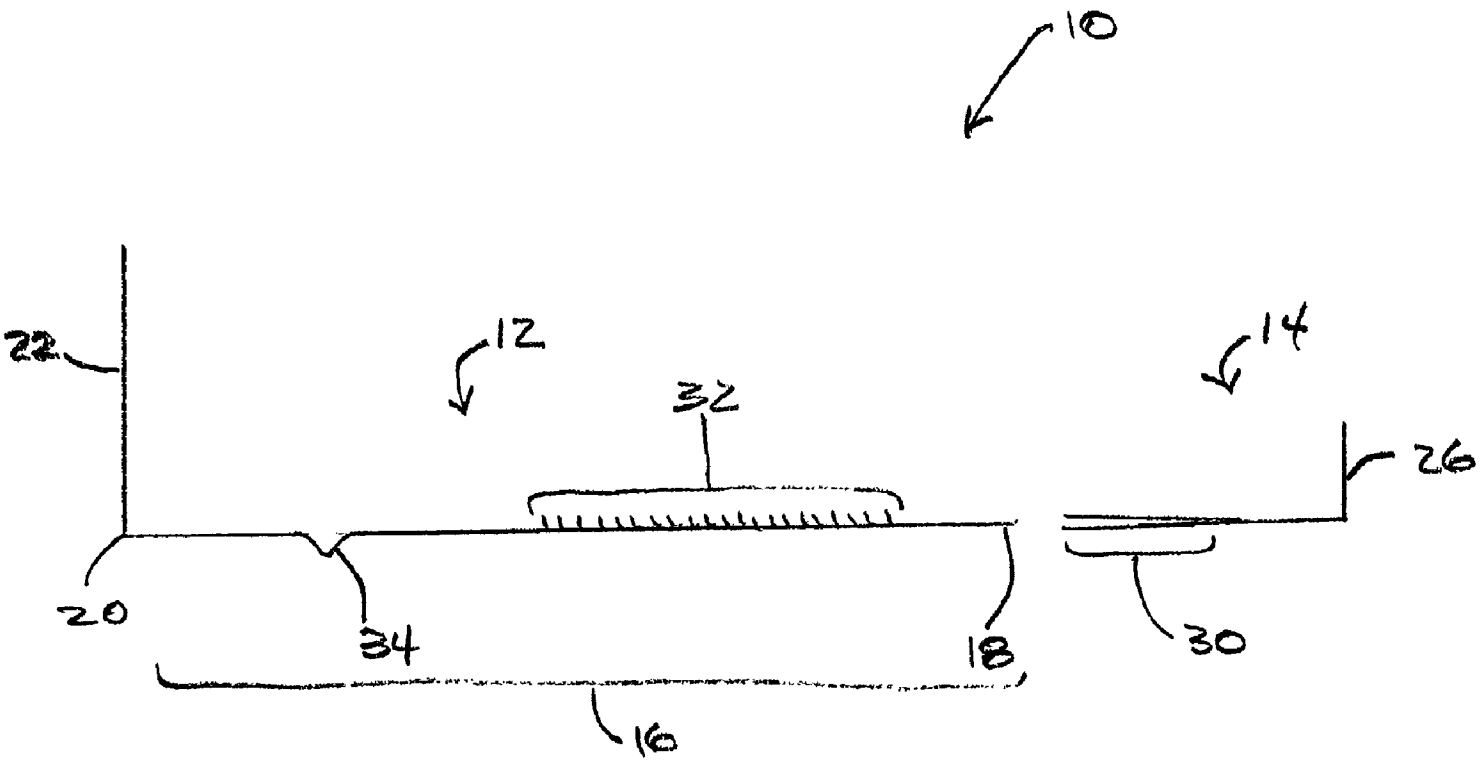
FIG. 3 is a side cross-sectional view of another embodiment of the soffit panel of FIG. 1.

FIGS. 1 through 3 illustrate an elongate, continuous soffit panel 10 according to the present invention. As best shown in the figures, the soffit panel 10 comprises a first member 12 and a second member 14. The first member 12 has a soffit portion 16 including a proximal periphery 18 and a generally parallel and spaced apart distal periphery 20 extending along a lengthwise dimension. The first member 12 also has a fascia portion 22 coextensive with the soffit portion 16 along the distal periphery 20 and extending generally upwardly therefrom for fastening the soffit panel 10 to roof fascia 24 of a building, as illustrated in FIG. 2.

The first member 12 is connected to the second member 14 by engaging the proximal periphery 18 of the first member with a channel 30 of the second member. The channel 30 may be variously formed for its intended purpose, as known to those skilled in the art, but is preferably an approximate "V" shape to receive therein the proximal periphery 18 of the first member. Connected in such fashion, the width of the soffit panel may be adjusted within limits by sliding the first member 12 slightly more or less into the channel 30. The second member 14 also includes a flange portion 26 extending generally at an angle from the soffit portion 16 of the first member 12 for fastening the soffit panel 10 to a side of a building 28. The first member 12 is adjustably connected to the second member 14, as described above and shown in FIGS. 1–3, so that the width of the soffit panel 10 is adjustably responsive to variations in distance between the side of the building 28 and the roof fascia 24. The second member 14 preferably includes the flange portion 26 extending generally upwardly in relation to the first member's soffit portion 16 when the first and second members are connected together. The flange portion 26 serves for fastening the soffit panel 10 to the side of a building 28 during installation, as illustrated in FIG. 2. In another preferred embodiment, as shown in FIG. 3, the soffit portion 16 is provided with a small protrusion or ridge extending along and spaced apart from the distal periphery 20. The ridge protrudes generally downwardly from the soffit portion 16 when the soffit panel 10 is properly installed on a building, and functions as a drip lip 34 to help prevent rain water from running along the soffit towards the wall of the building. The drip lip 34 may be of any suitable shape, however, a "V" shape has been found to work well.

Those skilled in the art will understand that the soffit portion 16 of the present invention is disposed with one or more openings for ventilation, air vents, or preferably with a plurality of openings 32 formed in the soffit portion 16 of the panel to thereby provide ventilation, as best shown in FIGS. 1–2. The soffit panel 10 is preferably constructed of an easily worked, weather resistant material such as sheet metal, and preferably of aluminum sheet metal. It should be understood that the present soffit panel 10 could also be fabricated of a synthetic, weather resistant plastic.

The soffit panel 10 of the invention preferably also includes the fascia portion 22 dimensioned to serve as the roof fascia, as shown in FIG. 2. That is, the fascia portion 22 of the soffit panel 10 may be of an adequate dimension for merely fastening the panel to an existing roof fascia 24, or it may be sufficiently dimensioned to constitute the entire roof fascia for the building, as seen in FIG. 2.

Another aspect of the present invention includes a building constructed having a roof eave including the elongate continuous soffit panel 10 herein described and illustrated. In this embodiment, the elongated dimension of the soffit panel preferably is sufficient to provide a single continuous soffit panel 10 for one entire exterior wall of the building.

An additional aspect of the invention includes a method of making the elongate continuous soffit panel having an adjustable width. The method comprises forming a first member including a soffit portion having a proximal periphery and a distal periphery disposed spaced apart, approximately parallel to each other, and extending along an elongated dimension of the soffit panel, and a fascia portion coextensive with the soffit portion along the distal periphery and extending generally upwardly therefrom. The method includes forming a second member having a flange portion, and a connecting portion, the flange portion extending generally at an angle from the connecting portion. Further, the method includes adjustably engaging the proximal periphery of the soffit portion of the first member with the connecting portion of the second member thereby connecting the first member to the second member along the proximal periphery of the soffit portion so that the width of the soffit panel can be adjusted.

In other embodiments of the method, forming a second member includes forming a channel in the connecting portion of the second member, and adjustably engaging comprises slidably engaging the proximal periphery of the soffit portion within the channel so that the width of the soffit panel can thereby be adjusted. Forming the first member may also include positioning an air vent in the soffit portion or alternatively, forming a plurality of openings in the soffit portion to thereby provide ventilation.

In the method, the steps of forming the first member and forming the second member preferably comprise forming sheet metal, and particularly aluminum sheet metal. Forming the first member comprises forming the fascia portion dimensioned to serve as the roof fascia. Also, forming the second member comprises forming the flange portion to extend generally upwardly from the soffit portion of the first member when the two members are connected together.

In accomplishing the method, preferably the first and second members are formed sufficiently elongated to provide a single continuous soffit panel for one wall of a building. Most advantageously, the first and second members are formed on-site at a building construction site. A particularly advantageous method includes forming the first and second members on-site at a building construction site, and connecting and installing the soffit panel on the building within eight hours of formation of the soffit panel, thereby accomplishing the entire job in one eight hour work shift.

Yet an additional aspect of the invention includes a method of constructing a building including at least one elongate continuous soffit panel having an adjustable width, as herein described.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A soffit panel for covering the underside of a building's roof overhang between an exterior wall of the building and roof fascia, said soffit panel consisting of:

a first member having a first soffit portion including a proximal periphery and a generally parallel and spaced apart distal periphery extending along a lengthwise dimension of said first member, and having a fascia portion extending along the distal periphery and positioned at an angle relative to the first soffit portion for fastening said first member to the roof fascia; and a second member having a second soffit portion and a flange portion extending generally at an angle relative to the second soffit portion for fastening the soffit panel to the external wall of the building, said second member being adjustably connectable to said first member so that the width of the soffit panel adjusts to variations in distance between the side of the building and roof fascia.

2. The soffit panel of claim 1, wherein said second member includes a channel for therein engaging the proximal periphery of the soffit portion thereby adjustably connecting the first member to the second member.

3. The soffit panel of claim 1, wherein the soffit portion includes at least one opening for ventilation.

4. The soffit panel of claim 1, wherein the soffit portion further comprises a drip lip to help prevent water from running along the soffit portion toward the side of the building.

5. The soffit panel of claim 1, wherein said soffit panel further comprises sheet metal.

6. The soffit panel of claim 1, wherein the soffit panel comprises aluminum sheet metal.

7. The soffit panel of claim 1, wherein the fascia portion is dimensioned to serve as the roof fascia.

8. The soffit panel of claim 1, wherein the flange portion extends generally upwardly from the soffit portion.

9. The soffit panel of claim 1, wherein the lengthwise dimension is sufficient to provide a continuous soffit panel for one wall of a building.

10. A soffit panel for the underside of a building's roof overhang between an exterior wall of the building and roof fascia, said soffit panel consisting of:

a first member having a soffit portion, and a fascia portion positioned at an angle relative to the soffit portion for fastening said first member to the roof fascia; and a second member having a channel wherein a periphery of said first member is engageably received to thereby connect the first member to the second member, the engagement of said first member in said channel having sufficient variability so that the width of the soffit panel is thereby adjustably responsive to variations in distance between the exterior wall of the building and the roof fascia.

11. A building comprising the soffit panel of claim 1.

12. A method of constructing a building, the method comprising installing the soffit panel of claim 1.

13. A building comprising the soffit panel of claim 10.

14. A method of constructing a building, the method comprising installing the soffit panel of claim 10.

* * * * *